US009714555B2

(12) United States Patent
Kjørholt et al.

(10) Patent No.: US 9,714,555 B2
(45) Date of Patent: Jul. 25, 2017

(54) METHOD OF PLUGGING A WELL

(71) Applicant: STATOIL PETROLEUM AS, Stavanger (NO)

(72) Inventors: Halvor Kjørholt, Trondheim (NO); Gisle Stjern, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 14/764,927

(22) PCT Filed: Jan. 31, 2013

(86) PCT No.: PCT/EP2013/051912

§ 371 (c)(1),
(2) Date: Jul. 30, 2015

(87) PCT Pub. No.: WO2014/117846

PCT Pub. Date: Aug. 7, 2014

(65) Prior Publication Data

US 2015/0361759 A1 Dec. 17, 2015

(51) Int. Cl.

| | |
|---|---|
| ***E21B 33/13*** | (2006.01) |
| ***E21B 33/134*** | (2006.01) |
| ***E21B 29/02*** | (2006.01) |

(52) U.S. Cl.

CPC ..... *E21B 33/13* (2013.01); *E21B 29/02* (2013.01); *E21B 33/134* (2013.01)

(58) Field of Classification Search

CPC ..... E21B 33/13; E21B 29/02; E21B 33/134; E21B 43/14; E21B 43/16

USPC ..... 166/297

See application file for complete search history.

(56) References Cited

U.S. PATENT DOCUMENTS

| | | | | |
|---|---|---|---|---|
| 2,591,807 | A | 4/1952 | Greene | |
| 2,696,258 | A | 12/1954 | Greene | |
| 2,696,259 | A | 12/1954 | Greene | |
| 3,053,182 | A | 11/1962 | Christopher | |
| 4,184,430 | A | 1/1980 | Mock | |
| 4,393,946 | A * | 7/1983 | Pottier | E21B 43/117 102/306 |
| 5,667,010 | A * | 9/1997 | Boyd | E21B 33/134 166/192 |
| 2003/0070812 | A1* | 4/2003 | Robertson | E21B 29/02 166/298 |
| 2011/0290485 | A1* | 12/2011 | Cooke, Jr. | E21B 23/02 166/286 |

(Continued)

FOREIGN PATENT DOCUMENTS

| | | |
|---|---|---|
| GB | 2 407 835 A | 5/2005 |
| WO | WO 2012/096580 A1 | 7/2012 |

*Primary Examiner* — Silvana Runyan

(74) *Attorney, Agent, or Firm* — Birch, Stewart, Kolasch & Birch, LLP

(57) ABSTRACT

A method of plugging a well extending into a hydrocarbon bearing formation fascilitates temporary or permanent abandonment of the well. The method includes detonating one or more explosive charges within a tubular or tubulars extending through the well in order to remove, fragment and or cut one or more sections of the tubulars around the entire circumference of the well to expose the surrounding formation or cement. The well is then filled in the region of the exposed surrounding formation or cement with a sealing material so as to form one or more plugs within the well to seal the well.

7 Claims, 6 Drawing Sheets

(56) References Cited

U.S. PATENT DOCUMENTS

2013/0312963 A1* 11/2013 Larsen ..... E21B 33/13
166/285

* cited by examiner

METHOD OF PLUGGING A WELL

TECHNICAL FIELD

The present invention relates to a method of plugging a well extending into a hydrocarbon bearing formation to facilitate either permanent or temporary abandonment of the well.

BACKGROUND

Oil and gas wells have in general three different purposes, as producers of hydrocarbons; injectors of water or gas for reservoir pressure support or for depositing purposes; or as exploration wells. At some point it is likely to be necessary to satisfactorily plug and seal these wells, e.g. after the wells have reached their end-of life and it is not economically feasible to keep the wells in service (so-called "plug and abandon"), or for some temporary purpose (e.g. "slot recovery" to seal off a reservoir to facilitate reuse of parts of the existing well to reach a new target). Plugging of wells is performed in connection with permanent abandonment of wells due to decommissioning of fields or in connection with permanent abandonment of a section of well to construct a new wellbore (known as side tracking or slot recovery) with a new geological well target.

A well is constructed by a hole being drilled down into the reservoir using a drilling rig and then sections of steel pipe, casing or liner are placed in the hole to impart structural integrity to the wellbore. Cement is placed between the outside of the casing or liner and the bore hole and then tubing is inserted into the casing to connect the wellbore to the surface. For ease of reference, all of these entities inserted into the well are referred to here as "tubulars". When the reservoir is to be abandoned, either temporarily or permanently, a well barrier must be established across the full cross-section of the well. This is generally achieved by removal of the tubulars from the well bore by cutting and pulling the tubulars to the surface. Well barriers are then established across the full cross-section of the well, in order to isolate the reservoir(s) and prevent flow of formation fluids between reservoirs or to the surface. This may require removal of a cement layer that surrounds the casing. In some cases, if the integrity of the cement layer can be verified, the cement layer may be left in place such that the cement layer forms part of the resulting plug.

To save having to remove an entire length of tubular from a well, a tool may be inserted into the well to cut the tubulars at a point beneath that at which the plug is to be formed, and only the upper detached part of the tubulars removed from the well. It is also possible to use a milling tool to mill away a part of the tubulars at the location where the plug is to be formed.

Regulations may require that an abandoned well be plugged so as to seal the well over at least some specified longitudinal extent, e.g. greater than 50 meters. An improperly abandoned well is a serious liability so it is important to ensure that the well is adequately plugged and sealed. However, the number of steps and equipment involved, such as the need for a full size rig or vessel, results in this stage of the life of the well being costly and time-consuming, at a time when the well no longer generates revenue.

Attempts have been made to increase the efficiency of the method of abandonment. For example, GB2407835 describes wellbore sealing wherein explosive charges are used to perforate a lower end of the tubing and then sealing fluid is pumped through the perforations so as to plug the well around the bottom end of the tubing. A similar approach is described in WO2012096580.

U.S. Pat. No. 2,591,807 relates to an apparatus that uses relatively low and high velocity explosive charges spaced at opposing ends of a container full of cement for placing in a zone of a wellbore whereby, upon ignition, cement is forced downwardly and outwardly to release cement into the cavity between the tubing and formation. U.S. Pat. No. 2,696,258 and U.S. Pat. No. 2,696,259 relate to an apparatus for depositing cement in a zone wherein the cement is contained within an elongated container and a gas generating charge is ignited to displace the cement through a lower outlet of the container into the zone. The charge expands the container into sealing contact with the casing, while at the same time rupturing the end of a tubular body to release cement into the wellbore.

SUMMARY

It is an object of the present invention to provide an improved method for plugging a well that reduces the number of steps involved in the process and/or removes or limits the need for a rig.

According to a first aspect of the present invention there is provided a method of plugging a well extending into a hydrocarbon bearing formation to facilitate temporary or permanent abandonment of the well. The method comprises detonating one or more explosive charges within a tubular or tubulars extending through the well in order to remove, fragment and or cut one or more sections of the tubulars around the entire circumference of the well to expose the surrounding formation or cement. The well is then filled in the region of the exposed surrounding formation or cement with a sealing material so as to form one or more plugs within the well to seal the well.

Two or more explosive charges in order to remove, fragment or cut a corresponding number of longitudinally spaced sections of tubing whilst leaving the intermediate sections of tubulars substantially in place.

The or each explosive charge may be configured to generate a directed blast, in a substantially radial direction. The blast may be configured such that the or each removed, fragmented or cut section of tubing has a longitudinal extent of at least 0.2 meters.

The method may comprise introducing the explosive charges into the well on one of; a cable, coil tubing, and drill pipe.

The method may comprise detonating said one or more explosive charges such that cement surrounding said sections of tubulars is substantially removed. In addition, a part of the surrounding formation may be subjected to energy giving rise to a freshly exposed surface to improve bonding to the sealant in addition to removing, fragmenting and or cutting the section(s) of tubulars.

The method may comprise activating a vibrator during said filling step and or during setting of the sealing material in order to improve the plug formation. The method may also comprise, for the or each plug to be formed, fixing a plug support within the tubular beneath the location at which the plug is to be formed.

The method may comprise detonating two or more explosive charges in order to remove, fragment or cut the or each section of tubular.

DETAILED DESCRIPTION

In the context of the need to plug wells for either temporary or permanent abandonment, it is proposed here to use explosive charges to blast away one or more sections of tubulars within the well, as well as the cement, thereby exposing the surrounding formation. Preferably, the blast is such that the formation itself is subjected to forces that give rise to a fresh and exposed formation surface to facilitate good bonding of the sealant. This is desirable as it will allow the plug when formed to more closely integrate with, and therefore seal to, the formation. Although the blast may be designed to remove also any cables and production tubing, these may be pulled separately from the well prior to detonation of the explosive charges. The explosives are arranged so as to give a radially directed blast effect. The charges must be configured to cut and remove all (possibly three) tubulars between the well and the formation.

Figure 1:
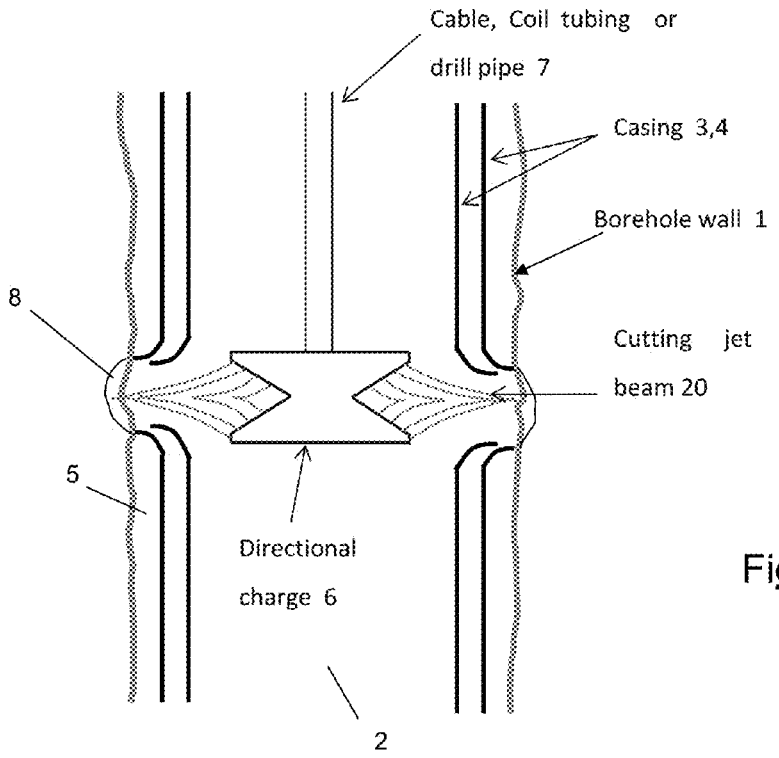
FIG. 1 illustrates schematically the use of a directional explosive charge to remove tubulars at a downhole location with a well.

FIG. 1 illustrates schematically a borehole wall 1 of a well 2 that is to be plugged. The well contains two concentrically aligned sections of casing 3, 4 and an outer cement layer 5. The Figure also shows an explosive charge 6 that has been lowered into the well on the end of a cable, coil tubing or drill string 7. The charge 6 is directional in the sense that it is configured to direct its force in a generally radial direction. FIG. 1 illustrates detonation of the charge 6 and the resulting removal of a longitudinally extending section of the casings 3, 4 and cement layer 5. The longitudinal extent of the removed section is such that an appropriate plug can subsequently be formed. This might be at least 0.2 meters, or at least 0.5 meters, but may be much greater. FIG. 1 illustrates a region 8 of damage caused by the blast, i.e. the cutting jet beam 20 resulting from gas expansion, to the surrounding formation. After the blasting procedure has been completed, some sort of calliper may be used to verify the cross section of the formation in the blast zone.

Figure 2:
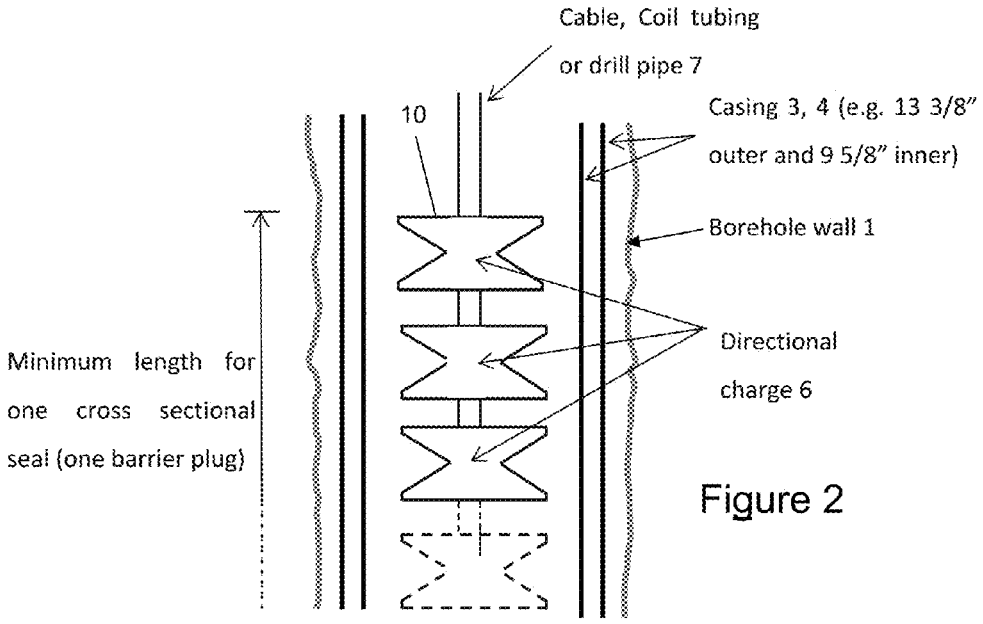
FIG. 2 illustrates schematically the use of a series of directional explosive charges to remove tubulars at a downhole location with a well over an extended well section.
Figure 3:
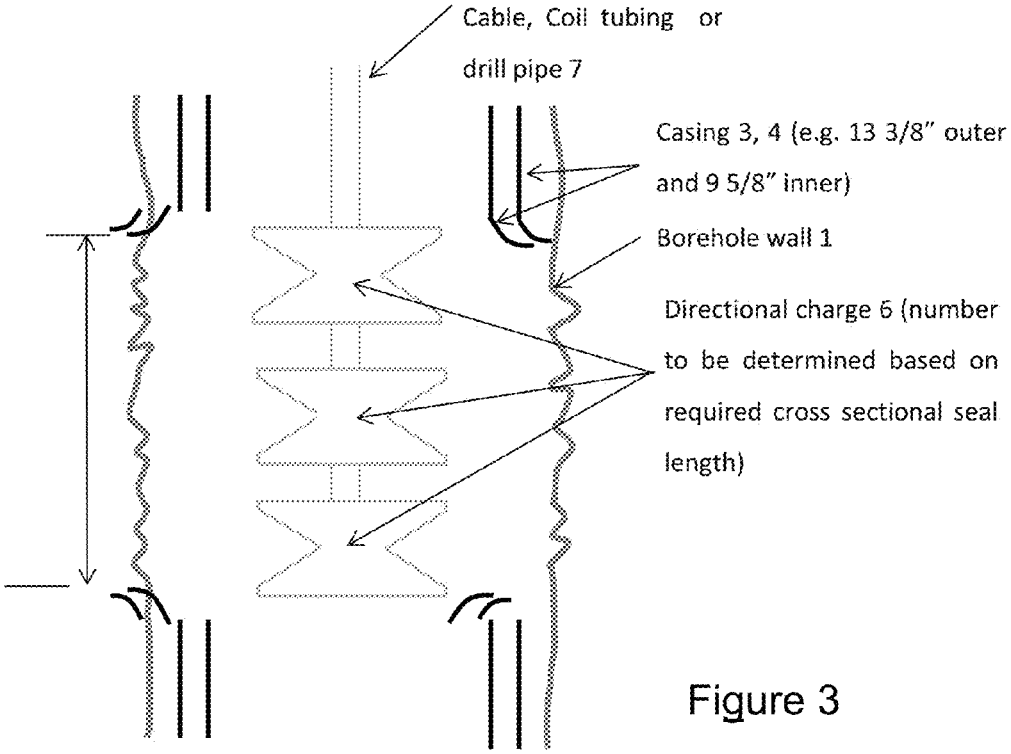
FIG. 3 illustrates schematically the downhole profile following detonation of the charges configured according to FIG. 2.

FIG. 2 illustrates schematically how a stack of directional charges 10 can be arranged to remove the well casing and lining over a relatively large longitudinal extent, or to make several independent cuts (see below). FIG. 3 shows the resulting removal of the casing and liners after detonation of several charges.

Figure 4:
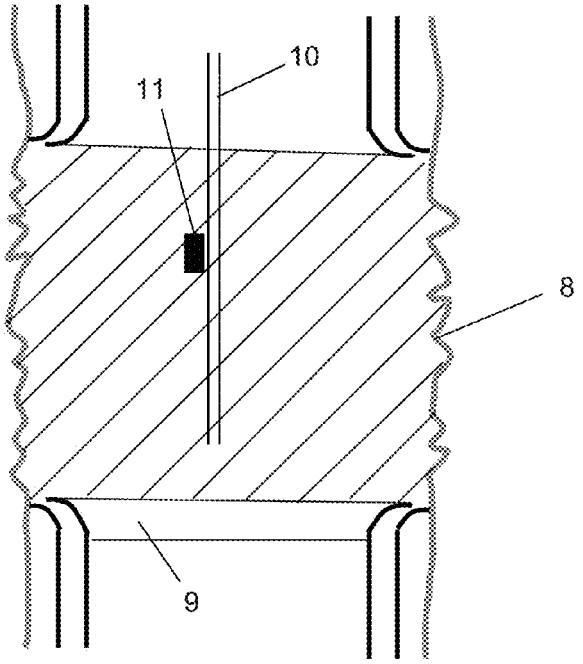
FIG. 4 illustrates schematically the formation of a plug following removal of a section of downhole tubulars.

After blasting the well will be sealed with cement or other sealant (e.g. a polymer composite such as an epoxy resin) that is injected or in another way transported into the treated section of the well. FIG. 4 illustrates a plug 8 formed in this way. A plug support 9 is typically located in the well beneath the plug location and prior to formation of the plug 8 in order to provide a support for the plug prior to setting of the sealant.

FIG. 4 further illustrates a sealant delivery pipe 10 that may be used to deliver sealant to the required location. The pipe 10 may be removed prior to setting of the sealant or may be left in situ (in the latter case, the pipe 10 should be filled with sealant). One or more vibrator units 11 may be hung on the delivery pipe and operated to cause the sealant to better flow into the desired space. Vibrator units 11 can be energized by, for example, electricity supplied from the surface, pressure from the injection flow, or a battery. Vibrator units may be left in the sealing plug or may be gradually pulled out of the well as the sealant is injected.

It may be found useful to treat the tubulars in the well prior to section blasting either by perforating, expanding (by cone, hydraulic pressure or explosives) or a combination of the two. One effect of this preparation is to minimize the void volume between the sealed sections to ease the cutting by the explosive charges, i.e. the presence of voids may cause the cutting jet beam to be deflected and or its effectiveness reduced.

Explosive charges or pressure in the well may also be used during or after placement of the sealant to ensure good contact with the formation and improve filling of voids. Separate injection tubes installed in the plug sections for post-hardening injection of sealant (e.g. filling up contraction voids) is an option.

Figure 5:
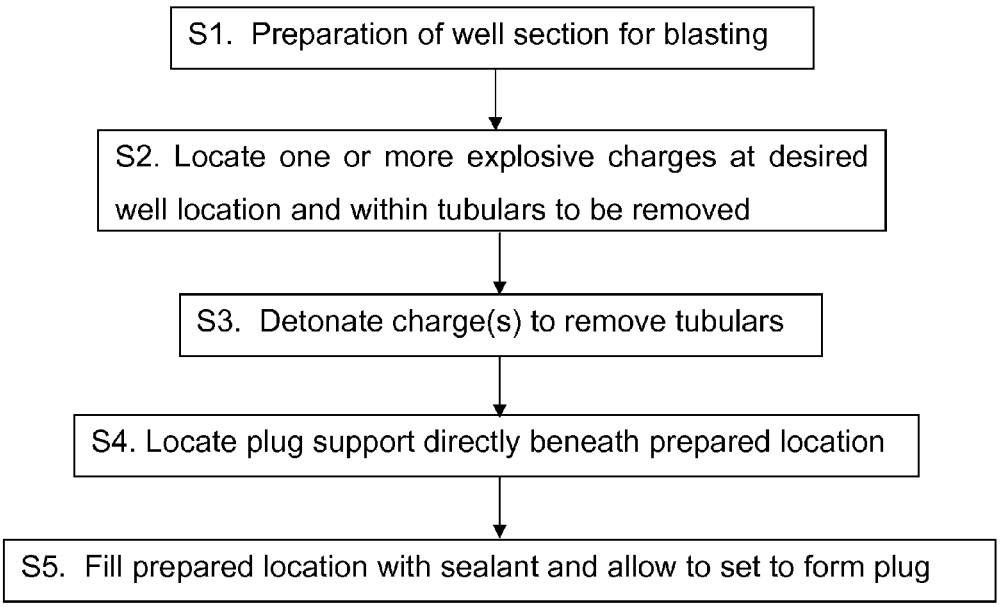
FIG. 5 is a flow diagram illustrating a method of removing downhole tubulars.

FIG. 5 is a flow diagram further illustrating the method presented above. Step 1 is an optional step of preparing a section of the well for blasting. This may involve removing cables and a production tubing. At step S2, one or more explosive charges are lowered into the well and positioned at the desired location. At step S3, the charge/s is/are detonated in order to remove or fragment (cut) the tubulars and cement layer (and any mud remains) at the desired location. Then, at step S5, a plug support is inserted through the web and located at a position directly beneath the prepared location. Finally, at step S5, the prepared location above the plug support is filled with a sealant which is allowed to set in order to form a well plug.

Figure 6:
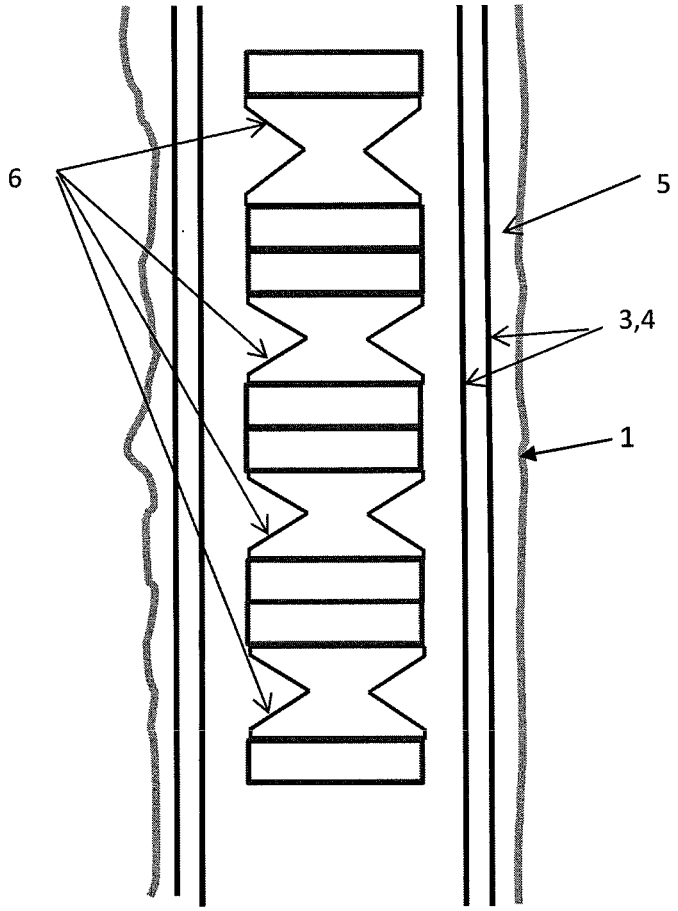
FIG. 6 illustrates schematically another embodiment according to the present invention.
Figure 7:
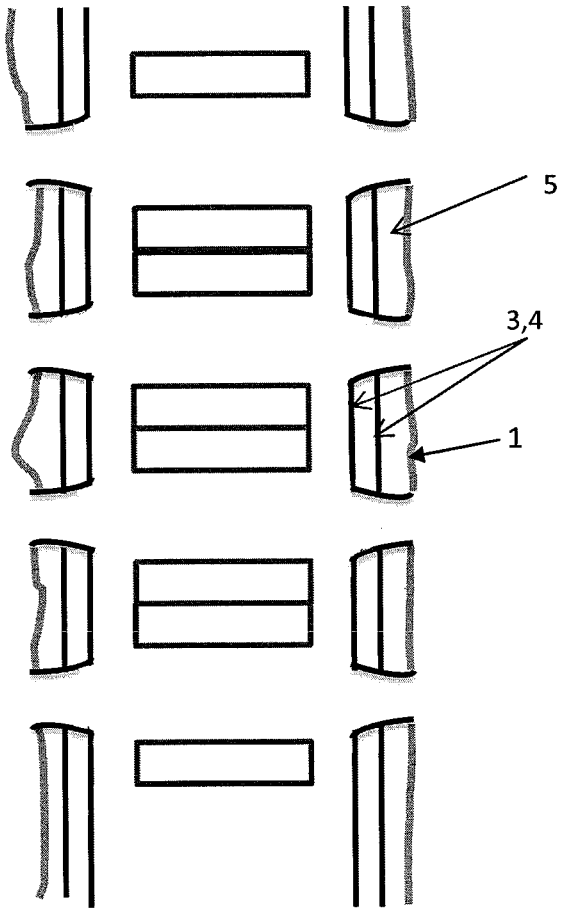
FIG. 7 illustrates schematically another embodiment according to the present invention.
Figure 8:
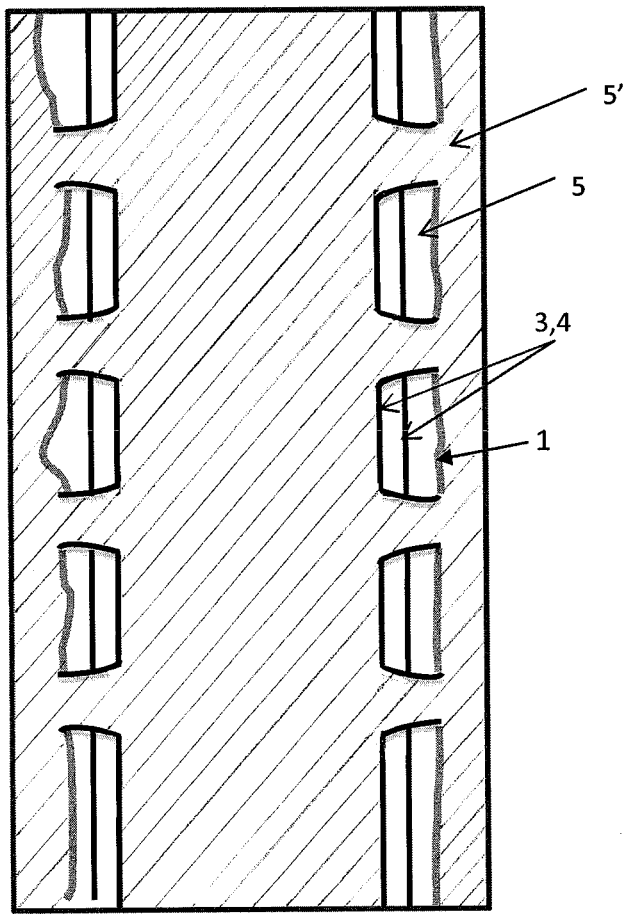
FIG. 8 illustrates schematically another embodiment according to the present invention.

FIGS. 6-8 show another embodiment where two or more explosive charges are provided in order to remove, fragment or cut a corresponding number of longitudinally spaced sections of tubing whilst leaving the intermediate sections of tubulars substantially in place. FIG. 8 shows the step of cementing after blasting.

It will be appreciated by the person of skill in the art that various modifications may be made to the above described embodiments without departing from the scope of the present invention.

The invention claimed is:

1. A method of plugging a well extending into a hydrocarbon bearing formation to facilitate temporary or permanent abandonment of the well, wherein the well comprises cement surrounding a tubular, the method comprising the steps of:

detonating two or more explosive charges within the tubular extending through the well in order to remove, fragment or cut corresponding number of two or more longitudinally spaced sections of the tubulars around the entire circumference of the well to expose the surrounding formation, while leaving intermediate sections of the tubular substantially in place, wherein each explosive charge is configured to generate a directed blast in a substantially radial direction around the entire circumference of the well; and filling the well in the region of the exposed surrounding formation or cement with a sealing material so as to form two or more plugs within the well to seal the well.

2. The method according to claim 1, further comprising the step of detonating said two or more explosive charges such that cement surrounding said sections of the tubular is substantially removed.

3. The method according to claim 1, further comprising the step of activating a vibrator during said filling step and or during setting of the sealing material in order to improve the plug formation.

4. The method according to claim 1, further comprising the step of, for the two or more plugs to be formed, fixing a plug support within the tubular beneath the location at which the plug is to be formed.

5. The method according to claim 1, wherein each removed, fragmented or cut section of the tubular has a longitudinal extent of at least 0.2 meters.

6. The method according to claim 5, further comprising the step of introducing explosives into the well on one of a cable, coil tubing, and drill pipe.

7. The method according to claim 6, further comprising the step of detonating said two or more explosive charges such that a part of the surrounding formation is subjected to energy giving rise to a freshly exposed surface to improve bonding to the sealant in addition to removing, fragmenting and or cutting the section(s) of the tubular.

* * * * *